United States Patent [19]

Scherer

[11] Patent Number: 4,842,173

[45] Date of Patent: Jun. 27, 1989

[54] BACKPACK FRAME

[75] Inventor: Michael J. Scherer, Boulder, Colo.

[73] Assignee: American Recreation Products, Inc., New Haven, Mo.

[21] Appl. No.: 159,785

[22] Filed: Feb. 24, 1988

[51] Int. Cl.[4] ..... A45F 3/08

[52] U.S. Cl. ..... 224/210; 224/212; 24/265 AL

[58] Field of Search ..... 224/210, 214, 212, 209, 224/261, 263, 153; 24/265 AL, 17 A, 599, 661, 324

[56] References Cited

U.S. PATENT DOCUMENTS

| | | | |
|---|---|---|---|
| 2,008,201 | 7/1935 | Chute | 224/262 |
| 2,790,222 | 4/1957 | Creedon | 24/324 |
| 3,181,216 | 5/1965 | Shears | 24/324 |
| 3,938,718 | 2/1976 | Madison | 24/265 AL X |
| 4,015,759 | 4/1977 | Dreisslgacker | 224/262 |
| 4,676,418 | 6/1987 | Lowe | 224/262 X |

FOREIGN PATENT DOCUMENTS

| | | | |
|---|---|---|---|
| 0026092 | of 1981 | European Pat. Off. | 224/210 |
| 217098 | of 1942 | Fed. Rep. of Germany | 224/210 |

*Primary Examiner*—Harvey C. Hornsby
*Assistant Examiner*—K. O'Leary
*Attorney, Agent, or Firm*—Senniger, Powers, Leavitt and Roedel

[57] ABSTRACT

A backpack frame of the present invention comprises a pair of spaced apart side frame members, a first cross plate member extending between the side frame members having a plurality of generally parallel slots therein extending in side-to-side direction with respect to the frame and spaced at intervals heightwise of the frame, a pair of shoulder straps for the frame having a first pair of loops attached thereto. Each loop of the pair is selectively insertable through one of the slots in the first cross plate member according to the desired heightwise position of the respective shoulder strap relative to the frame and is movable along the slot to a desired lateral position of the shoulder strap relative to the frame. A clip is provided for retaining each loop in the selected slot in the desired lateral position.

10 Claims, 3 Drawing Sheets

BACKPACK FRAME

BACKGROUND OF THE INVENTION

The invention relates generally to backpack frames, and more particularly to a backpack frame which provides for convenient lateral and heightwise adjustment of the shoulder straps relative to the frame.

In using backpack frame, it is frequently necessary to adjust the position of the shoulder straps to accommodate the size and comfort requirements of any given user. While such adjustment is possible in many conventional designs, it is typically time-consuming and inconvenient. Accordingly, there is a need for a backpack frame which is designed to overcome this problem.

Reference may be made to U.S. Pat. Nos. 3,856,191 and 3,938,718 for patents generally in the field of this invention.

SUMMARY OF THE INVENTION

Among the several objects of this invention may be noted the provision of a backpack frame which is readily adjustable according to the size of the wearer's back; the provision of such a backpack frame which provides for quick and easy adjustment of the shoulder straps both laterally and heightwise of the frame to afford the best possible fit on a user's back; the provision of such a frame which is lightweight and pleasing in appearance; and the provision of such a frame which is durable for long-lasting use.

Briefly, a backpack frame of the present invention comprises a pair of spaced apart side frame members, a first cross plate member extending between the side frame members having a plurality of generally parallel slots therein extending in side-to-side direction with respect to the frame and spaced at intervals heightwide of the frame, and a pair of shoulder straps for the frame having a first pair of loops attached thereto. Each loop of the pair is selectively insertable through one of the slots in the first cross plate member according to the desired heightwise position of the respective shoulder strap relative to the frame and is movable along the slot to a desired lateral position of the shoulder strap relative to the frame. A clip is provided for retaining each loop in the selected slot in the desired lateral position.

Other objects and features will be in part apparent and in part pointed out hereinafter.

BRIEF DESCRIPTION OF THE DRAWINGS

Corresponding reference numerals indicate corresponding parts throughout the several views of the drawings.

DESCRIPTION OF THE PREFERRED EMBODIMENT

Figure 1:
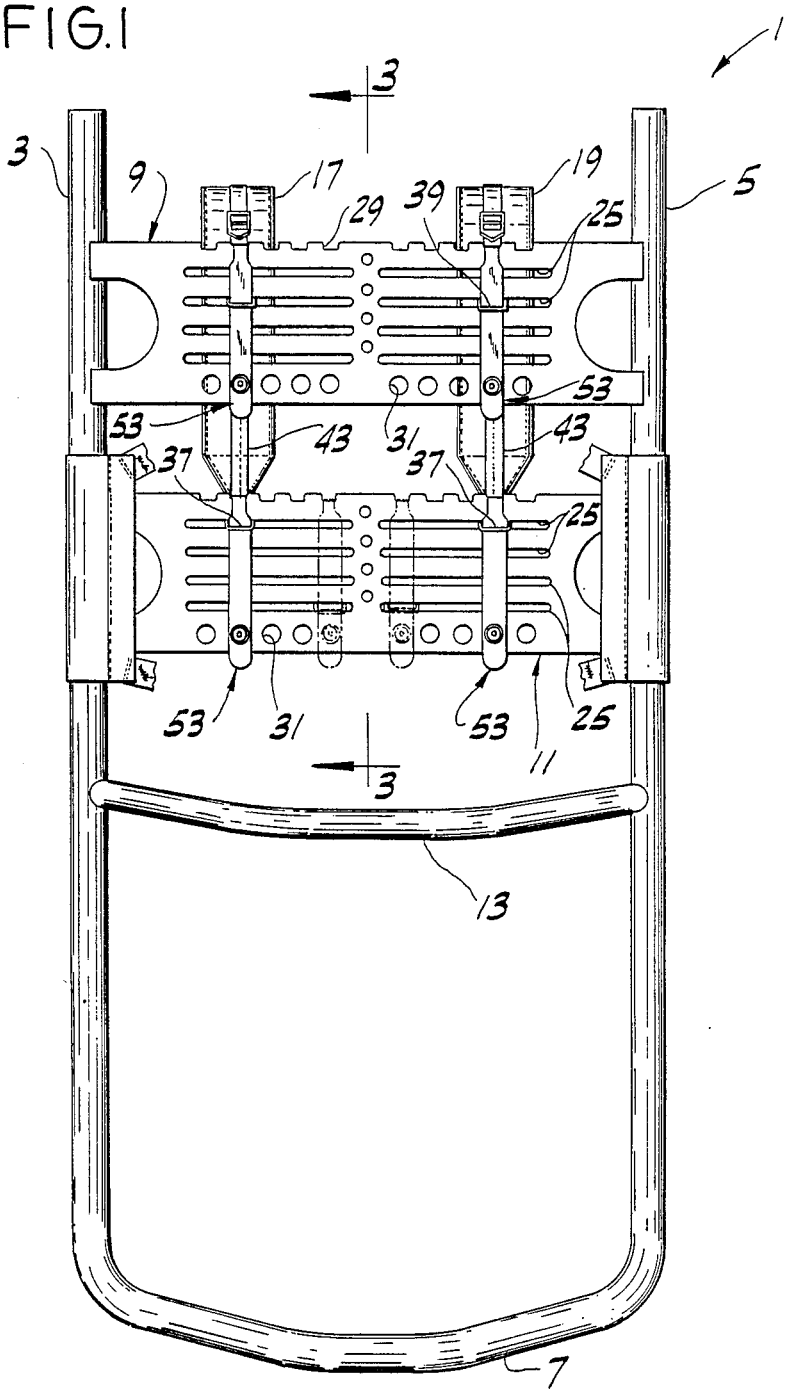
FIG. 1 is an rear elevational view of a backpack frame of the present invention.
Figure 2:
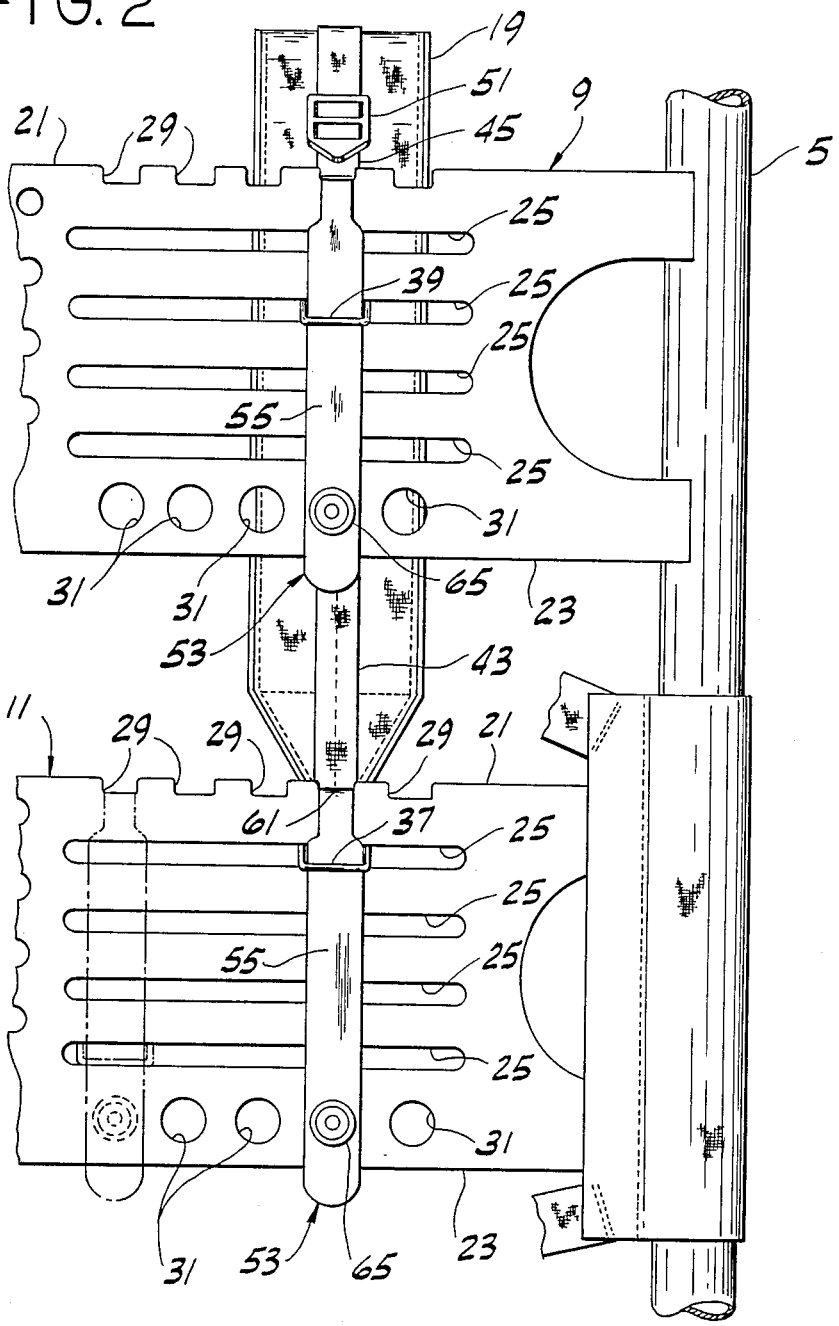
FIG. 2 is an enlarged portion of FIG. 1 showing details of the frame.

Referring now to the drawings, a backpack frame of the this invention, indicated in its entirety by the reference numeral 1, is shown as comprising a pair of parallel spaced apart side frame members 3, 5 integrally connected by a bottom cross frame member 7. These frame members are preferably (but not necessarily) formed by round tubular bar stock of suitable lightweight metal bent into the configuration shown in FIG. 1. A first (upper) cross plate member, generally designated 9, extends between the cross frame members 3, 5 adjacent the top of the frame, and an identical second (lower) cross frame member, generally designated 11, extends between the side frame members 3, 5 immediately below the upper cross plate member 9. Both cross plate members 9, 11 are formed from wide relatively thin metal webs rigidly joined at their ends (as by welding) to the side frame members. The cross plate members are preferably curved outwardly to conform to the back of the person wearing the backpack. A cross bar 13 spanning the side frame members 3, 5 below the lower cross plate member 11 provides additional strength and rigidity to the frame. Indicated at 17 and 19 are left and right shoulder staps for carrying the frame. As will appear, the present invention involves a unique design for securely connecting the shoulder straps 17, 19 to the cross plate members 9, 11 while providing for ready adjustment of the shoulder straps both heightwise and laterally (left and right) with respect to the frame. For the sake of clarity, certain strapping, webbing, belting and other conventional parts of a backpack frame have been omitted from the drawings since they are not relevant to this invention. It will be understood, however, that the frame is equipped with such conventional parts.

The upper and lower cross plate members 9, 11 are substantially identical in construction. Each is generally rectangular in shape (as viewed in FIG. 1) with first (upper) and second (lower) generally parallel edges indicated at 21 and 23, respectively, and each has a plurality of slots 25 therein extending in side-to-side direction with respect to the frame. As illustrated, the slots 25 are arranged in twe sets on opposite sides of the vertical centerline of the frame. Each set comprises a series of long generally parallel slots (four slots are shown but this number may vary) spaced at intervals (e.g., $\frac{3}{4}$-inch intervals from the horizontal centerline of one slot to the horizontal centerline of an adjacent slot) heightwise of the frame. The upper edge 21 of each cross plate member 9, 11 has a series of notches 29 therein spaced at suitable intervals (e.g., $\frac{3}{4}$-inch intervals from the vertical centerline of one notch to the vertical centerline of an adjacent notch) along the edge above each set of slots. Each notch 29 extends down from the upper edge 21 and has a relatively straight flat bottom, the significance of which will become apparent. Each cross plate member 9, 11 also has a series of openings therein in the form of circular holes 31 disposed generally adjacent the lower edge of the cross plate member below each set of slots. These holes 31 are spaced at intervals corresponding to the intervals at which the notches 29 are spaced, the arrangement being such that there is a hole disposed vertically below each notch.

Figure 3:
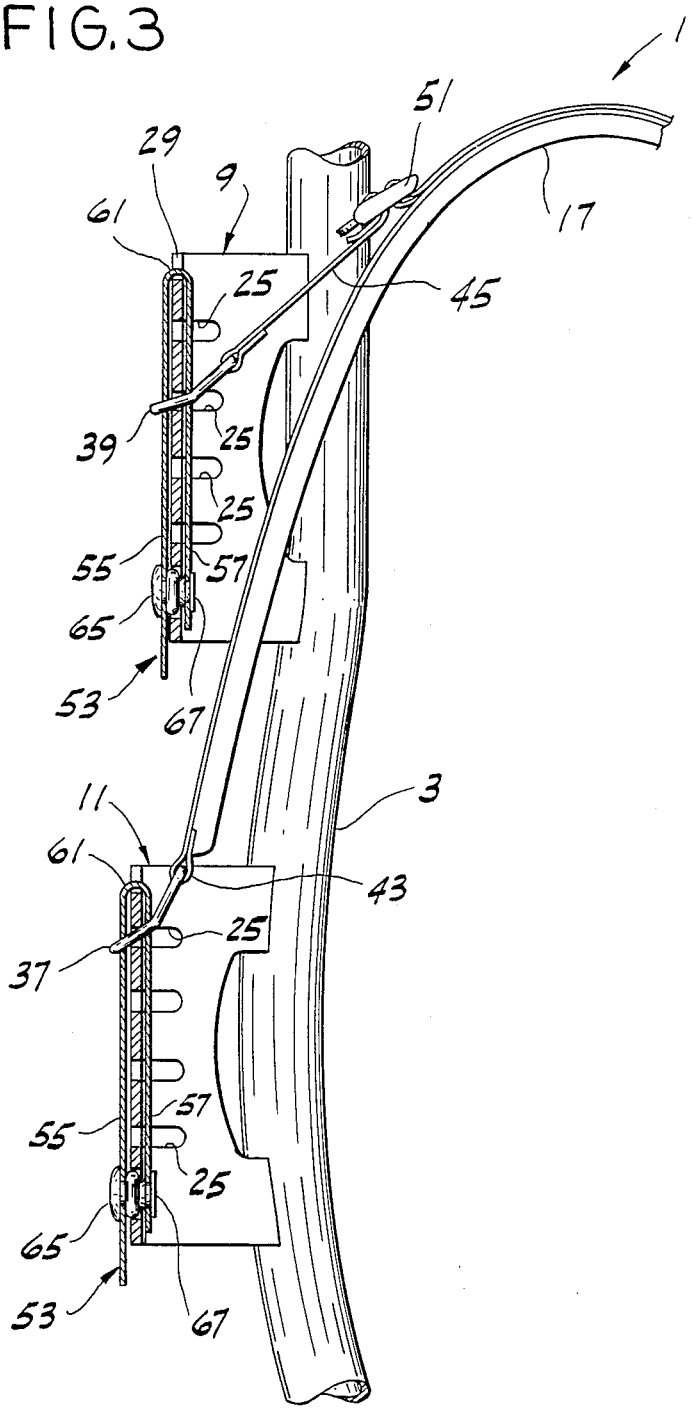
FIG. 3 is an enlarged vertical section taken on line 3—3 of FIG. 1.

As illustrated, the shoulder straps 17, 19 have a first (lower) pair of generally rectangular metal loops, each designated 37, attached thereto at their lower rearward ends, and a second (upper) pair of metal loops, each designated 39, attached thereto at locations immediately rearward of the portion of the straps which arch over the shoulders. The lower loops 37 are attached to the straps by a suitable strips 43 of webbing extending the length of the shoulder straps on the outer surfaces of the shoulder straps, and the upper loops 39 are secured by straps 45 attached (as by stitching) to the aforementioned strips 43 of webbing (see FIG. 3). The lower loops 37 are adapted to be inserted through selected slots 25 in the lower cross plate member 11 and secured in place in the manner described below. Similarly, the upper loops 39 are adapted to be inserted through selected slots 25 in the upper cross plate member 9 and secured in place in the manner described below. Thus, by selecting the appropriate slots, the position of the shoulder straps 17, 19 may adjusted heightwise relative to the frame. Moreover, the loops are slidable in the slots to effect adjustment of straps laterally of the frame (i.e., in side-to-side direction with respect to the frame). The length of straps 45 is adjustable by means of suitable buckles 51 to vary the angular orientation of the frame relative to the back of the wearer as viewed from the side of the wearer (see FIG. 3).

Each loop 37, 39 is retained in its respective selected slot 25 by retaining means comprising a clip generally designated 53 formed from a metal strip bent to have a pair of relatively narrow generally parallel arms 55, 57 integrally joined at one of their ends (their upper ends as shown in the drawings) via a U-shaped juncture 61 having a relatively small radius of curvature. The juncture is adapted to be positioned in a selected notch 29 in the upper edge of a respective cross plate member 9, 11 (the notch selected will depend on the desired lateral position of the shoulder strap relative to the frame) with one arm 55 of the clip 53 extending down across the outwardly-facing surface of the cross plate member 9, 11 and through the loop 37, 39, and the other arm 57 extending down across the inwardly-facing surface of the cross plate membei The width of the arms 55, 57 adjacent the juncture is slightly less than the width of each notch 29 in the upper edge 21 of a respective cross plate member, the arrangement being such that the clip 53 is adapted for a relatively close fit in the selected notch with the rounded juncture 61 of the arms seated against the lower edge of the notch.

Each clip 53 has quick-operating fastening means comprising circular male and female snap fastening elements 65, 67 at the lower ends of its arms 55, 57 for releasably holding the arms together in a position embracing a respective cross plate member 9, 11 and preventing movement of the clip out of its selected notch 29 to ensure that the shoulder strap 17, 19 remains in its laterally adjusted position. It will be understood in this regard that the male and female snap fastening elements 65, 67 are interengageable through a respective opening 31 in a respective cross plate member.

In view of the foregoing, it will be apparent that the position of the shoulder straps 17, 19 may be adjusted heightwise relative to the frame 1 by selecting the appropriate slots 25 through which to insert the upper and lower loops 39, 37, and that the position of the shoulder straps may be adjusted laterally relative to the frame by sliding the loops to the appropriate position in the slots. The loops may then be secured in fixed position by inserting the four clips 53 in appropriate notches 29 and then snap-fastening the arms of each clip together through an appropriate hole 31 in a respective cross plate member. Readjustment of the position of the shoulder straps may be quickly and easily accomplished simply by unsnapping the arms of the clips, repositioning the clips in the appropriate new slots and/or notches, and resnapping the arms.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A backpack frame comprising a pair of spaced apart side frame members, a first cross plate member extending between the side frame members having a plurality of generally parallel slots therein extending in side-to-side direction with respect to the frame and spaced at intervals heightwise of the frame and first and second edges extending in side-to-side direction with respect to the frame and a series of notches spaced at intervals along said first edge, a pair of shoulder straps for the frame having a first pair of loops attached thereto, each loop of the pair being selectively insertable through one of the slots in the first cross plate member according to the desired heightwise position of the respective shoulder strap relative to the frame and being movable along the slot to a desired lateral position of the shoulder strap relative to the frame, and means for retaining each loop in the selected slot in said desired lateral position, said retaining means comprising a clip having a pair of generally parallel arms joined at one of their ends via a juncture, said juncture being receivable in a selected notch in said series of notches with one arm of the clip extending heightwise across one face of the first cross plate member through a respective loop of said first pair of loops and the other arm extending heightwise across the opposite face of the first cross plate member, and quickoperating fastening means adjacent the other ends of the arms for releasably holding the arms together in a position embracing the first cross plate member and preventing movement of the clip out of said notch, and wherein said first cross plate member has a series of openings therein extending laterally across the plate member generally adjacent its second edge, said openings being spaced at intervals corresponding to the notch intervals in said first edge of the first cross plate member, said quick-operating fastening means including fastening elements on the arms adapted to interengage one another in an opening corresponding to the notch in said first edge in which the juncture of the clip is received.

2. A backpack frame as set forth in claim 1 wherein said quick-operating fastening means comprises a snap fastener including interengageable snap fastening elements on the arms.

3. A backpack frame as set forth in claim 2 wherein the openings in said series of openings are configured to correspond to the shape of said snap fastening elements.

4. A backpack frame as set forth in claim 2 wherein said first edge of the first cross plate member is constituted by the upper edge of the cross plate member and said second edge is constituted by the lower edge of the cross plate member.

5. A backpack frame as set forth in claim 2 wherein said slots in the first cross frame member are arranged in two sets, one set for each loop of said first pair of loops, on opposite sides of the vertical centerline of the first cross plate member, each set of slots comprising a series of generally parallel slots spaced at intervals heightwise of the first cross plate member.

6. A backpack frame comprising a pair of spaced apart side frame members, a first cross plate member extending between the frame side members having a plurality of generally parallel slots therein extending in side-to-side direction with respect to the frame and spaced at intervals heightwise of the frame, a pair of shoulder straps for the frame having a first pair of loops attached thereto, each loop of the pair being selectively insertable through one of the slots in the first cross plate member according to the desired heightwise position of the respective shoulder strap relative to the frame and being movable along the slot to a desired lateral position of the shoulder strap relative to the frame, means for retaining each loop in the selected slot in said desired lateral position, a second cross plate member extending between the side frame members above the first cross plate member, said second cross frame member having a plurality of generally parallel slots therein extending in side-to-side direction with respect to the frame and spaced at intervals heightwise of the frame and first and second edges extending in side-to-side direction with respect to the frame, and a series of notches spaced at intervals along said first edge, a second pair of loops attached to each shoulder strap, each loop of said second pair of loops being selectively insertable through one of the slots in the second cross plate member according to the desired heightwise position of the respective shoulder strap relative to the frame and being movable along the slot to a desired lateral position of the shoulder strap relative to the frame, and means for retaining each loop of said second pair of loops in the selected slot in said desired lateral position, said retaining means comprising a clip having a pair of generally parallel arms joined at one of their ends via a juncture, said juncture being receivable in a selected notch in said series of notches with one arm of the clip extending heightwise across one face of the second cross plate member through a respective loop of said second pair of loops and the other arm extending heightwise across the opposite face of the second cross plate member, and quick-operating fastening means adjacent the other ends of the arms for releasably holding the arms together in a position embracing the second cross plate member and preventing movement of the clip out of said notch, and wherein said second cross plate member has a series of openings therein extending laterally across the plate member generally adjacent its second edge, said openings being spaced at intervals corresponding to the notch intervals in said first edge of the second cross plate member, said quick-operating fastening means including fastening elements on the arms adapted to interengage one another in an opening corresponding to the notch in said first edge in which the juncture of the clip is received.

7. A backpack frame as set forth in claim 6 wherein said quick-operating fastening means comprises a snap fastener including interengageable snap fastening elements on the arms.

8. A backpack frame as set forth in claim 7 wherein the openings in said series of openings are configured to correspond to the shape of said snap fastening elements.

9. A backpack frame as set forth in claim 7 wherein said first edge of the second cross member is constituted by the upper edge of the cross plate member and said second edge is constituted by the lower edge of the cross plate member.

10. A backpack frame as set forth in claim 7 wherein said slots in the second cross frame member are arranged in two sets, one set for each loop of said second pair of loops, on opposite sides of the vertical centerline of the second cross plate member, each set of slots comprising a series of generally parallel slots spaced at intervals heightwise of the second cross plate member.

* * * * *